United States Patent [19]

Aoki

[11] 4,126,490

[45] Nov. 21, 1978

[54] COMPOSITION FOR FORMING CHROMATE COATING

[75] Inventor: Kohsaku Aoki, Sagamihara, Japan

[73] Assignee: Caterpillar Mitsubishi Ltd., Tokyo, Japan

[21] Appl. No.: 901,378

[22] Filed: May 1, 1978

[51] Int. Cl.[2] ..... C23F 7/26

[52] U.S. Cl. ..... 148/6.21; 148/6.2

[58] Field of Search ..... 148/6.2, 6.21

[56] References Cited

U.S. PATENT DOCUMENTS

| | | | |
|---|---|---|---|
| 3,053,693 | 9/1962 | Schuster et al. | 148/6.2 |
| 3,066,055 | 11/1962 | Pimbley | 148/6.2 |
| 3,391,031 | 7/1968 | Russell et al. | 148/6.2 |
| 3,397,090 | 8/1968 | Champaneria et al. | 148/6.2 |
| 3,501,352 | 3/1970 | Shah | 148/6.2 |
| 3,808,057 | 4/1974 | Labenski et al. | 148/6.2 |
| 3,857,739 | 12/1974 | Prust et al. | 148/6.16 |
| 3,895,969 | 7/1975 | Miller | 148/6.2 |
| 3,907,610 | 9/1975 | Yamagishi et al. | 148/6.2 |
| 4,036,667 | 7/1977 | Simon | 148/6.27 |

*Primary Examiner*—Ralph S. Kendall

*Attorney, Agent, or Firm*—John L. James

[57] ABSTRACT

Compositions for forming chromate coatings on zinc metal or zinc alloys typically contain water as a solvent with hexavalent chromium compounds therein as active ingredients. Such hexavalent chromium compounds are environmentally undesirable. An aqueous composition for forming a chromate coating on zinc metal or zinc alloys is provided which does not contain hexavalent chromium compounds. The composition contains a trivalent chromium compound, an alum and a vanadate.

6 Claims, No Drawings

COMPOSITION FOR FORMING CHROMATE COATING

TECHNICAL FIELD

This invention relates to the coating of metal, particularly to a chromate coating for the reduction of corrosion of zinc metal or zinc alloys.

BACKGROUND ART

Typically, commercially available compositions for forming chromate coatings, which are also known as a chromate treatment agents, comprises water as a solvent and contain incorporated therein a hexavalent chromium compounds as a main ingredient in combination with suitable proportions of a fluoride, a mineral acid, a carboxylic acid, a surfactant and other chemicals. When a work-piece, for example a zinc plated metal piece, is immersed in such a chromate treatment agent, complex compounds of tri-and hexa-valent chromiums are deposited on the surface of the work-piece to form a chromate coating. Such chromate treatment agents are disclosed in U.S. Pat. Nos. 3,053,693; 3,501,352; 3,808,057; 3,857,739; 3,895,969; and 3,907,610.

U.S. Pat. No. 3,053,693 which issued on Sept. 11, 1962 to Ludwig K. Schuster and Alfonso L. Baldi discloses a coating mixture in the form of an aqueous dispersion of a non-waxy hydrophobic resin containing a dissolved chromium compound from the class consisting of chromic acid which contains hexavalent chromium and the water-soluble dichromates of metals which have a valence greater than one.

U.S. Pat. No. 3,501,352 which issued on Mar. 17, 1970 to Vinod D. Shah discloses a composition containing a chromium chromate complex. The chromium chromate complex is prepared from aqueous chromic acid solutions which containn hexavalent chromium.

U.S. Pat. No. 3,808,057 issued on Apr. 30, 1974 to Wolfgang Lobenski, Heiny Paul Schapitz and Hans-Peter Wessel. This patent discloses a method for coating metal articles by first depositing a layer of zinc on the metal article then submerging the article in a chromic acid solution.

U.S. Pat. No. 3,857,739 issued on Dec. 31, 1974 to Michael Ward Prust and Wayne Charles Glassman and discloses a process for producing a chromium protective coating on zinc. The process utilizes chromium in the water soluble hexavalent form.

U.S. Pat. No. 3,895,969 which issued on July 22, 1975 to Russell C. Miller discloses a chromate depositing solution which contains hexavalent chromium.

U.S. Pat. No. 3,907,610 issued on Sept.

23, 1975 to Hidehisa Yamagishi, Hirokuni Mizuno, Yoshitaka Kashiyama and Yasuhiro Toyoda. This patent discloses a process for treating metal which uses hexavalent chromium.

Many heavy metals and elements, such as lead, mercury and arsenic for example, are dangerous when ingested or absorbed by animal tissues. These materials are environmentally undesirable and great care is taken to insure that they do not pollute the air or water. Hexavalent chromium compounds are environmentally undesirable because of monochromium trioxide is deliquescent meaning that it absorbs moisture. Monochromium trioxide absorbs water and forms undesirable chromic acid. Conversely, bivalent and trivalent chromium compounds are environmentally acceptable.

It is therefore desirable to provide a chromate treatment agent which contains and produces no hexavalent chromium compound and which does not pose an environmental concern.

DISCLOSURE OF INVENTION

In one aspect of the present invention, an aqueous composition for forming a chromate coating on the surface of zinc metal contains a trivalent chromium compound.

The composition does not contain any hexavalent chromium compounds and does not form any. Thus, the zinc metal can be coated without subjecting people or animals to environmentally undesirable hexavalent

BEST MODE FOR CARRYING OUT THE INVENTION

A composition contains, as an ingredient indispensable for the formation of a useful chromate coating, at least 1 g/l of a trivalent chromium compound, or otherwise it may only form a coating of insufficient corrosion resistance. The maximum amount of the trivalent chromium compound is limited to about 50g/l from the viewpoint of economy. Typical of the trivalent chromium compounds which may be used in the composition of the invention are chromium nitrate, chromium chloride, chromium sulfate and chromium hydroxide. These trivalent chromium compounds may be used alone or in combination.

The composition should also contain at least 3g/l of at least one alum, or otherwise it may only form a coating of poor corrosion resistance. The use of the alum in excess of 130g/l is unnecessary and rather disadvantageous in view of high costs. Examples of suitable alums include, for example, aluminum potassium sulfate, aluminum sodium sulfate and aluminum ammonium sulfate.

A soluble vanadate is also present in the composition in an amount of 0.2–10g/l. With less than 0.2g/l of the vanadate the obtainable coating is poor in corrosion resistance whereas the maximum amount of the vanadate is limited to 10g/l from costs and solubility considerations. While any soluble vanadates, including metavanadates, pyrovanadates and orthavanadates may be used, ammonium metavanadate is most preferable.

The composition should contain at least 0.5g/l of a mineral acid, or otherwise a coating of a poor corrosion resistance will be formed. The maximum amount of the mineral acid is limited to 25g/l because of a reduced corrosin resistance of the coating due to excessive etching.

In the case where the surface of a substrate to be treated with the composition is clear a surfactant is not necessarily required. However, where a dense chromate coating is desired, a required amount of surfacant, usually within the range of between about 0.1 and 5g/l may be added to the composition.

Chromate treatment of the surface of the workpiece with the composition is conveniently carried out by bringing the surface in contact with the composition, for example, by dipping the work-piece in the composition. While the treatment temperature is not narrowly critical, the treatment may conveniently be carried out at ambient temperature or slightly elevated temperatures of up to about 50° C. The treatment time is also not limitative, but it usually takes about 5 to 90 seconds.

A chromate coating which is formed on the surface of zinc metal or zinc alloy, such as the surface of a zinc-plated steel panel, when such a surface is treated with the composition, comprises trivalent chromium compounds and contains no hexavalent chromium compound. The coating so formed has an excellent corrosion resistance and an improved paint adhesion.

INDUSTRIAL APPLICABILITY

Several aspects of the composition for forming a chromate coating are described by the following Examples. In Examples 1 through 3, each specimen as prepared, treated, tested and estimated in a manner as noted below.

(1) A rectangular (1.0 × 50 × 75 mm) JIS G3141 cold drawn steel specimen (bright finished) having a 2 mm hole at each corner was plated with zinc to a thickness of 4–4.5 microns. The plated specimen was immersed in a chromate treatment liquor. After the completion of the treatment the specimen was removed from the liquor, immediately and thoroughly washed with tap water, and dried by an air stream.

(2) The specimen so treated was subjected to a continuous salt water spraying in accordance with ASTM B117-54T for a period of 24 hours.

(3) Based on the total surface area of the tested specimen the percent of the sum of those areas where white rust had developed was determined, and depending upon the determined percent the corrosion resistance of the specimen was rated as follows.

| Percent of White Rust Areas | Rating |
|---|---|
| 0% | 1 |
| about 1% | 2 |
| about 3% | 3 |
| about 8% | 4 |
| about 14% | 5 |
| about 20% | 6 |
| about 30% | 7 |
| about 50% | 8 |
| 100% | 9 |

EXAMPLE 1

Tests were carried out with compositions and treatment conditions as indicated in Table 1, wherein "A" is chromium nitrate, "B" is aluminum potassium sulfate, "C" is ammonium metavanadate, and "D" is hydrochloric acid.

TABLE 1

| Test | Composition of Treatment Liquid (g/l)-In Water | | | | Treatment Condition | | Corrosion Resistance |
|---|---|---|---|---|---|---|---|
| No. | A | B | C | D | Time (sec) | Temp. | Rating |
| 1 | 6.7 | — | — | — | 10 | Ambient | 9 |
| 2 | 10 | 10 | — | — | " | " | 7 |
| 3 | 6.7 | 20 | — | — | " | " | 7 |
| 4 | 10 | " | — | — | " | " | 7 |
| 5 | 10 | 30 | — | — | " | " | 7 |
| 6 | 10 | 40 | — | — | " | " | 7 |
| 7 | 10 | 50 | — | — | " | " | 8 |
| 8 | 6.7 | — | 1 | 3.4 | " | " | 6 |
| 9 | 6.7 | — | 1.5 | " | " | " | 5 |
| 10 | 6.7 | 2.5 | 1 | " | " | " | 5 |
| 11 | 6.7 | 10 | 1 | " | " | " | 8 |
| 12 | 6.7 | 20 | 1 | " | " | " | 8 |
| 13 | 6.7 | 30 | 1 | " | " | " | 2 |
| 14 | 6.7 | 40 | 1 | " | " | " | 3 |
| 15 | 5.0 | 15 | 1.18 | 2.55 | " | " | 2 |
| 16 | 6.7 | 10 | 1.5 | 3.4 | " | " | 3 |
| 17 | 6.7 | 20 | 1.5 | " | " | " | 2 |
| 18 | 6.7 | 30 | 1.5 | " | " | " | 3 |
| 19 | 6.7 | 40 | 1.5 | " | " | " | 3 |
| 20 | 6.7 | 20 | 2.25 | 5.1 | " | " | 2 |
| 21 | 10 | 30 | 2.25 | " | " | " | 1 |

EXAMPLE 2

Tests were carried out with compositions and treatment conditions as indicated in Table 2, wherein "A" is chromium nitrate, "B" is aluminum potassium sulfate, "C" is ammonium metavanadate, and "D" is hydrochloric acid.

TABLE 2

| Test | Composition of Treatment Liquid (g/l)- In Water | | | | Treatment Condition | | Corrosion Resistance |
|---|---|---|---|---|---|---|---|
| No. | A | B | C | D | Time (Sec) | Temp. | Rating |
| 1 | 1 | 3 | 0.225 | 0.51 | 90 | Ambient | 3 |
| 2 | 1.5 | 4.5 | 0.35 | 0.76 | 60 | " | 3 |
| 3 | 3 | 9 | 0.675 | 1.53 | 10 | " | 3 |
| 4 | 3 | 9 | 0.675 | 1.53 | 20 | " | 3 |
| 5 | 4 | 12 | 0.9 | 2.04 | 10 | " | 2 |
| 6 | 20 | 60 | 4.5 | 10.20 | 10 | " | 2 |
| 7 | 40 | 80 | 6 | 20.39 | 10 | " | 3 |
| 8 | 40 | 120 | 9 | 20.39 | 10 | " | 3 |
| 9 | 40 | — | 6 | 20.39 | 10 | " | 5 |

EXAMPLE 3

Tests were carried out with the typical composition and varying treatment conditions as indicated in Table 3, wherein "A" is chromium nitrate, "B" is aluminum potassium sulfate, "C" is ammonium metavanadate, and "D" is hydrochloric acid.

TABLE 3

| Test | Composition of Treatment Liquid (g/l)- In Water | | | | Treatment Condition | | Corrosion Resistance |
|---|---|---|---|---|---|---|---|
| No. | A | B | C | D | Time (Sec) | Temp. | Rating |
| 1 | 10 | 30 | 2.25 | 5.1 | 5 | Ambient | 2 |
| 2 | " | " | " | " | 10 | " | 1 |
| 3 | " | " | " | " | 20 | " | 2 |
| 4 | " | " | " | " | 30 | " | 2 |
| 5 | " | " | " | " | 40 | " | 3 |
| 6 | " | " | " | " | 60 | " | 3 |
| 7 | " | " | " | " | 10 | 42 | 1 |
| 8 | " | " | " | " | " | 50 | 1 |
| 9 | " | " | " | " | " | 60 | 2 |
| 10 | " | " | " | " | " | 68 | 2 |
| 11 | " | " | " | " | " | 81 | 2 |

EXAMPLE 4

The chromate treated test specimen from Example 3, Test No. 3 and a similar test specimen, which had been obtained using a commercially available chromate treatment liquid containing a hexavalent chromium compound were tested for paint adhesion. Each specimen was sprayed with a primer to a thickness of about 25 microns and allowed to stand for 48 hours. A cross incisure about 12.7 by 25.4 mm (0.5 × 1.0 inch) was scarred on the primer coating with a knife, and an adhesive tape (Scotch tape No. 610' supplied by 3-M Corp.) was adhered so as to completely cover the incisure. The tape was then suddenly peeled off, and the state of peeling of the primer in the vicinity of the incisure was examined with the naked eye. If any peeling of the primer was noted the pain adhesion of the test specimen was rated as being poor whereas if no peeling of the primer was observed the paint adhesion was rated as being good. The results are shown in the following Table.

| Test No. | Test Specimen | Remarks |
|---|---|---|
| 1 | Specimen treated with a treatment liquor according to the invention. | No peeling |

-continued

| Test No. | Test Specimen | Remarks |
|---|---|---|
| 2 | Specimen treated with a commercial treatment liquor containing a Cr(VI) compound. | No peeling |

EXAMPLE 5

The chromate treated test specimens from Example 3, Test Nos. 2, 3 and 4 were analyzed for the composition of the coating.

Method 1—Measurement of Cr(VI) in the Coating

The chromate coating of the specimen was dissolved in $H_2SO_4$ (1+). The solution was taken in a beaker, to which an appropriate amount of a solution of diphenylcarbazide was added. The sample was taken in a 50 ml messflask, and water was added thereto to the level of the indicator line C, the concentration of $H_2SO_4$ at the time of color development being 2.0M, and thereafter the concentration of Cr(VI) was spectrophotometrically determined.

Method 2—Detection of Cr(VI) After Oxidation

The chromate coating of the specimen was dissolved in $H_2SO_4$ (1+1). The solution was taken in a beaker, and adjusted to a pH value of 6 to 7 with sodium hydroxide. Sodium peroxide was added to the beaker and the resultant solution was boiled to a volume of about 10 ml. The concentrated solution was cooled with water and a solution of diphenylcarbazide was added thereto to develop color.

The dissolved area of the test specimen in Methods (1) and (2) was 75 $cm^2$.

| | | Results of Method 1 | |
|---|---|---|---|
| Classification | Test No. | Treatment Liquor and Conditions | Concentration of Cr(VI), ppm |
| According to the invention | 1 | Example 3, Test No. 2 | Not detected |
| | 2 | Example 3, Test No. 3 | Not detected |
| | 3 | Example 3, Test No. 4 | Not detected |
| Outside the invention | | Commercial liquor containing Cr(VI), ambient temperature 10 sec. | 0.21 |

| | | Results of Method 2 | |
|---|---|---|---|
| Classification | Test No. | Treatment Liquor and Conditions | Color Developed by Diphenylcarbazide |
| According to the invention | 1 | Example 3, Test No. 2 | Red |
| | 2 | Example 3, Test No. 3 | Red |
| | 3 | Example 3, Test No. 4 | Red |

The above-tabulated results reveal that the chromate coatings formed with the chromate treatment liquors do not contain hexavalent chromium and that after being oxidized they develop color by means of diphenylcarbazide. It is believed, therefore, that the chromate coatings formed with the compositions in accordance with the invention comprises a trivalent chromium compound or compounds.

The composition for forming a chromate coating on the surface of zinc metal or zinc alloy comprises water as a solvent and contains dissolved therein 1–50g/l of a trivalent chromium compound, 3–130g/l of an alum, 0.2–10g/l of a vanadate, 0.5–25g/l of a mineral acid and optionally an amount of a surfactant.

The chromate treatment agent contains and produces no hexavalent chromium chromium compound and chromate treatment may be carried out in an environment of safety without suffering from any pollution problems.

Other aspects, objects and advantages of this invention can be obtained from a study of the disclosure and appended claims.

What is claimed is:

1. An aqueous composition for forming a chromate coating on the surface of zinc metal or zinc alloy substantially free of hexavalent chromium compounds comprising:

a trivalent chromium present compound within the range of about 1 to 50 grams per liter;

an alum present within the range of about 3 to 130 grams per liter; and a vanadate present within the range of about 0.2 to 10 grams per liter.

2. An aqueous composition, as set forth in claim 1, wherein the trivalent chromium compound is chosen from the group consisting of chromium nitrate, chromium chloride, chromium sulfate and chromium hydroxide.

3. An aqueous composition, as set forth in claim 1, wherein the alum is chosen from the group consisting of aluminum potassium sulfate, aluminum sodium sulfate and aluminum ammonium sulfate.

4. An aqueous composition, as set forth in claim 1, wherein the vanadate is chosen from the groups consisting of metavanadates, pyrovanadates, and orthovanadates.

5. An aqueous composition, as set forth in claim 1, wherein the vanadate is ammonium vanadate.

6. An aqueous composition, as set forth in claim 1, including a mineral acid present within the range of about 0.5 to 25 grams per liter.

* * * * *